United States Patent [19]

Becavin

[11] Patent Number: 4,692,768

[45] Date of Patent: Sep. 8, 1987

[54] FEED DEVICE FOR A SWEEP BEAM ARRAY ANTENNA

[75] Inventor: Henri G. Becavin, Bretigny sur Orge, France

[73] Assignee: Thomson CSF, Paris, France

[21] Appl. No.: 545,008

[22] Filed: Oct. 24, 1983

[30] Foreign Application Priority Data

Oct. 26, 1982 [FR] France ..... 82 17917

[51] Int. Cl.[4] ..... H01Q 3/22; H01Q 3/24; H01Q 3/26

[52] U.S. Cl. ..... 342/368; 342/371; 342/373

[58] Field of Search ..... 343/368, 369, 370, 371, 343/372, 373, 374; 342/368, 369, 370, 371, 372, 373, 374

[56] References Cited

U.S. PATENT DOCUMENTS

| | | | |
|---|---|---|---|
| 3,368,202 | 2/1968 | Crousel | 343/373 |
| 3,474,447 | 10/1969 | Melancon | 343/371 |
| 3,518,695 | 6/1970 | Schroeder | 343/372 X |
| 3,573,837 | 4/1971 | Reindel | 343/374 X |
| 3,680,109 | 7/1972 | Steudel | 343/371 |
| 3,803,625 | 4/1974 | Nemit | 343/368 |
| 4,228,436 | 10/1980 | DuFort | 343/371 |
| 4,257,050 | 3/1981 | Ploussios | 343/372 |
| 4,318,104 | 3/1982 | Enein | 343/372 |
| 4,424,500 | 1/1984 | Viola et al. | 343/373 X |
| 4,489,325 | 12/1984 | Bauck et al. | 343/374 |

*Primary Examiner*—Theodore M. Blum
*Assistant Examiner*—John B. Sotomayor
*Attorney, Agent, or Firm*—Cushman, Darby & Cushman

[57] ABSTRACT

A feed device for a sweep beam array antenna which has a plurality of elementary antennae combined into a plurality of sub-arrays having a predetermined overlap at their ends. Each sub-array includes a plurality of elementary groups, each elementary group including N elementary antennae. Each elementary group is fed by a feed circuit having N inputs and N outputs. Circuitry is provided for grouping together an arbitrary number of said elementary groups to form an assembly comprising MN elementary antennae, where M is greater than N, and MN antennae are the number of antennae in a sub-array. This circuitry is connected to an energy distributor and includes a plurality of divider distributor circuits, each one coupled to an output of the energy distributor. Each divider distributor circuits has M outputs. The circuitry also includes a plurality of adder distributor circuits, each one having N outputs coupled to the N inputs of a respective one of said elementary groups. Each adder distributor circuit has M inputs which are coupled to the M outputs of predetermined ones of the divider distributor circuits according to a predetermined, periodic law.

14 Claims, 11 Drawing Figures

FEED CKTS
ADDER DISTRIBUTORS
DIVIDER DISTRIBUTORS
ENERGY DISTRIBUTOR
F/C
A/D
D/D
R1
R2
R01
R02
R03
R04
R05
R06
R07
C1
C2
C3
C4
C5
C6
F1
F2
F3
Ph1
Ph2
Ph3
ND0
3
I
II
III

F/C
A/D
D/D
R4
R5
R01
R02
R03
R04
R05
R06
C1
C2
C3
C4
C5
C6
F1
F2
F3
F4
F5
S1
S2
S4
S5
S8
S12
Ph1
Ph2
Ph3
Ph4
Ph5
4-DO
ENERGY DISTRIBUTOR
FEED CKT'S
ADDER DISTRIBUTORS
DIVIDER DISTRIBUTORS

FEED DEVICE FOR A SWEEP BEAM ARRAY ANTENNA

BACKGROUND OF THE INVENTION

1. Field of the Invention

The present invention relates to a feed device for a sweep beam array antenna. Such an antenna is intended to produce a beam in which the position of the maximum is controlled by a number of phase-shifters disposed in the feed lines.

2. Description of the Prior Art

For a number of reasons and more particularly for reasons of cost and reliability, it is desirable to reduce as much as possible the number of control phase-shifters.

Determination of the minimum of phase-shifters is known; it depends on a number of factors among which may be mentioned:

$F_1(\theta)$: directivity of an elementary antenna;

$D_o$: spacing between elementary antennae;

$\theta_o$: sweep range of the beam.

The total diagram may be written in the methematical form:

$$E(\theta)=F_1(\theta)\times F_2[Do(\sin\theta_1-\sin\theta)]$$

in which $F_2$ is maximum for the values of its argument equal to k, k being a positive, negative or zero integer.

Depending on Do, the spacing between two elementary antennae, there will be a principal maximum for $\theta=\theta_o$ and secondary maxima equal to the principal for:

$$\sin\theta_p-\sin\theta_o=\pm K/Do$$

but these secondary maxima are undesirable for they give false directional indications. The useful sweep range of the beam is then limited by the appearance of these secondary maxima. One means for solving this problem of limitation of the sweep range consists in striving for elementary diagrams such that $F_2(\theta)$ is zero for $|\theta|>\theta o$ and the ideal would be a rectangular diagram $F_1$. With such a diagram, the spacing Do between sources could be equal to $1/\sin\theta$. But to obtain this diagram, it would be necessary to have an antenna with infinite directivity requiring an elementary source of infinite spread.

These considerations are known and on pages 256–258 of the work "Phased array antennas" by Olmer and Knittel edited by ARTECH HOUSE, a solution to the problem is proposed, consisting in creating sub-arrays, i.e. in grouping together a number of elementary antennae and in feeding them appropriately from an energy distributor, so that these sub-arrays each radiate an approximately rectangular lobe with phase centers separated from each other by a distance such that the secondary maxima of the assembly of sub-arrays are shifted outside the principal lobe.

One embodiment giving a solution to the problem of the limitation of the number of phase-shifters with respect to the elementary radiating sources for obtaining a sweep range of the beam which is not too limited, may be found in U.S. Pat. No. 4,228,436 entitled "Limited sweep phase array". In this patent, there is essentially considered an interconnection circuit having T outputs and P inputs, T corresponding to the number of elementary sources contemplated and P to that of the phase-shifters. In this case, a number of circuits M is considered such that $M=T/P\geqq 3$.

One embodiment described in this American patent gives a good result with a sub-array comprising $T^2$ antennae for an interval between sub-arrays equal to TDo, Do being the spacing between two elementary antennae. However, in this solution, since T is at maximum equal to 2 or 3, the sweep range still appears too limited for most applications.

Moreover, with the device described in this American patent an optimum amplitude and phase distribution over the different antennae, giving a rectangular radiation lobe, cannot be obtained, the advantage of the system is thus reduced.

SUMMARY OF THE INVENTION

The aim of the present invention is to define a feed device for a sweep beam array antenna which is free of the above-mentioned drawbacks.

According to the invention, a feed device for a sweep beam array antenna, in which the elementary antennae spaced apart by an elementary interval Do have been divided into several sub-arrays overlapping at their ends, is characterized in that it comprises elementary groups each connected respectively to N elementary antennae and comprising N inputs as well as means combining together an arbitrary number of said elementary groups, forming a whole comprising M.N elementary antennae where M is greater than N and the spacing between two assemblies or sub-arrays being equal to N elementary intervals Do.

The advantage conferred by such a feed can be seen straightaway; it allows the amplitude and phase distribution as well as the number of antennae of the sub-array and their spacing to be adjusted independently.

BRIEF DESCRIPTION OF THE DRAWINGS

Other features of the invention as well as advantages will appear from the following description with reference to the accompanying figures which show.

DETAILED DESCRIPTION OF THE PREFERRED EMBODIMENT

It was pointed out in the introduction to the present application that the feed device for a sweep beam array antenna must be such that it provides a useful sweep range of the beam which is as limited as possible and such that, at the limit, the radiation diagram of the principal lobe of the antenna approximates as much as possible a rectangular shape.

To approximate these conditions, according to the prior art, the antennae of the array were divided up into a number of sub-arrays for reducing in a first stage the number of phase-shifters required for sweeping space by the beam formed. The sub-arrays formed from the array are characterized by the number of antennae which they comprise and by the interval which separates two adjacent sub-arrays. Depending on the way in which the sub-arrays are fed, some disadvantages exist, in paticular a certain limitation of the sweep range due to the fact that the feed device can only adequately feed, i.e. with a certain number of independent currents, a relatively small number of elementary antennae.

The feed device of the invention overcomes these drawbacks by providing several separate feeds for the antennae of the sub-arrays divided into elementary groups through two groups of circuits which have been defined, the arrangement of these circuits further allowing the distribution of the amplitude and the phase to be adjusted independently.

Figure 1:
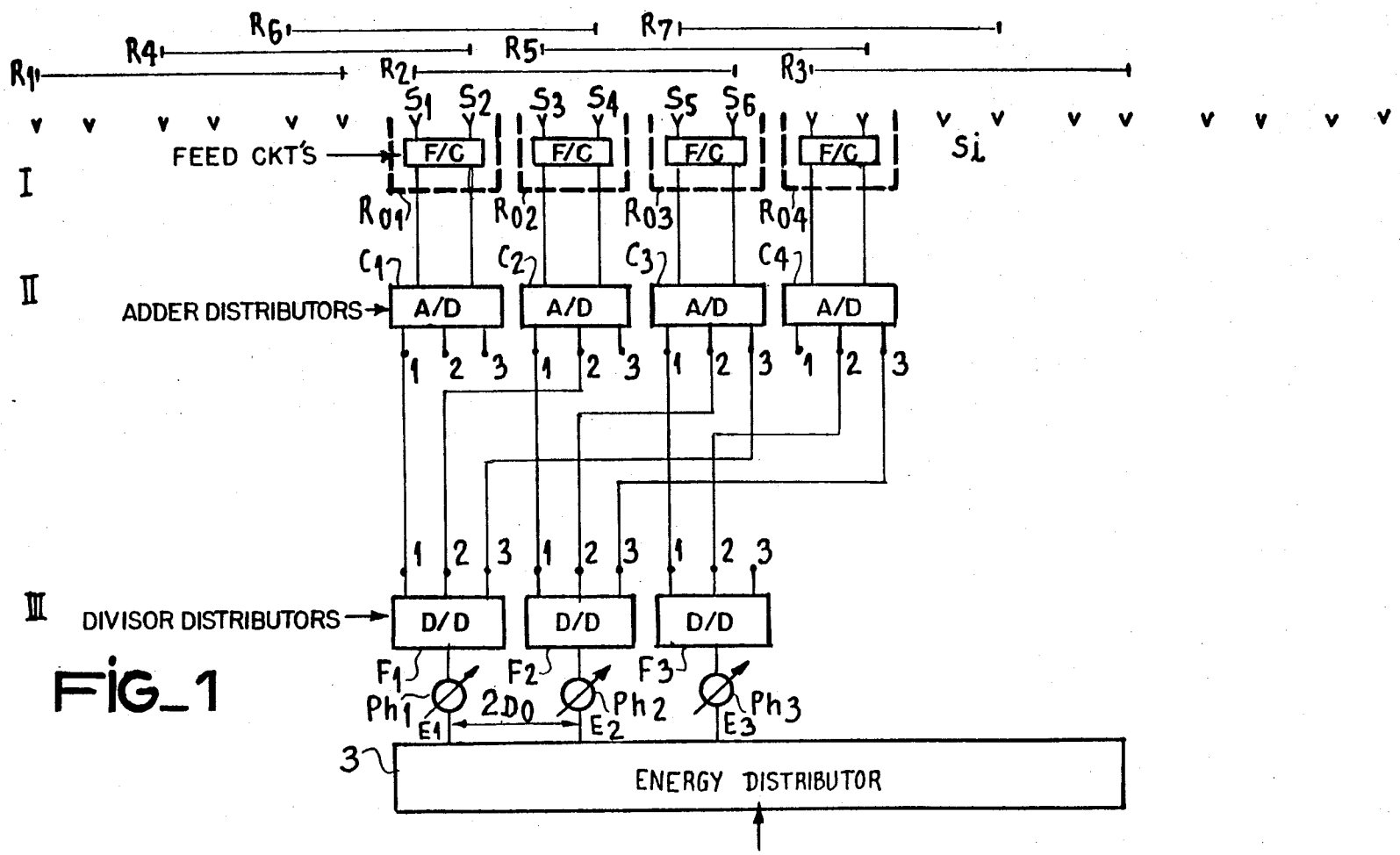
FIG. 1, a device in accordance with the invention for feeding elementary groups comprising two elementary antenna belonging to a number of sub-arrays of six elementary antennae.

FIG. 1 shows a feed device in accordance with the invention, feeding a number of elementary groups Roi into which the sub-arrays are divided. The elementary groups are characterized by the relatively small number, from 2 to 5 or 6, elementary antennae which they comprise. In this case, elementary groups have been chosen comprising $N=2$ elementary antennae $S_i$.

The sub-arrays considered are shown by the references $R_1$ to $R_7$ and each comprises 6 elementary antennae. Only 7 sub-arrays have been shown separated from each other by N elementary intervals Do, so here 2 Do, for a total array comprising 30 antennae. The elementary groups are referenced $Ro_1$ to $Ro_4$ and form an assembly I. Each elementary group comprises an equal number of inputs and outputs. Here this number N is equal to 2. Assemblies II and III form the means combining together a certain number of the elementary groups Roi in accordance with the invention. Assembly II comprises a certain number of circuits called adder distributors $C_1$ to $C_4$ and assembly III comprises a certain number of circuits called divider distributors $F_1$ to $F_3$ which are each connected by a phase-shifter Phi to an energy distributor 3 whose corresponding outputs are spaced apart by two elementary spacings Do. In accordance with the invention, assemblies II and III combine together MN elementary antennae, that is here 6 elementary antennae, M being equal to 3 and N to 2.

In the example of FIG. 1, the antennae are fed from several separate feeds in the following way.

The divider distributor circuits $F_1$, $F_2$, $F_3$ each comprise one input and three outputs and distribute the energy delivered by distributor 3 respectively to the three inputs of the adder distributor circuits $C_1$,$C_2$,$C_3$,$C_4$ whose two outputs feed respectively an elementary group, i.e. here $Ro_1$, $Ro_2$, $Ro_3$, $Ro_4$.

It can be seen that the number of the outputs of a divider distributor circuit is equal to the number of the inputs of an adder distributor circuit and that each output of a divider distributor $F_1$ for example is connected to an input bearing the same numeral index of the successive adder dividers; thus, output 1 of circuit $F_1$ is connected at input 1 to circuit $C_1$; output 2 of circuit $F_1$ is connected to the input 2 of circuit $C_2$; the output 3 of circuit $F_1$ is connected to the input 3 of circuit $C_3$, the output 1 of circuit $F_2$ is connected to the input 1 of circuit $C_2$, the output 2 of circuit $F_2$ is connected to the input 2 of circuit $C_3$ and the output 3 of circuit $F_2$ is connected to the input 3 of circuit $C_4$ and so on for circuit $F_3$. It can be clearly seen in this example that the antennae of an elementary group belonging to several sub-arrays, for example the antennae of groups $Ro_3$ and $Ro_4$ belonging to sub-arrays $R_2$, $R_5$,$R_3$,$R_7$,$R_6$ receive several separate feeds.

Figure 2:
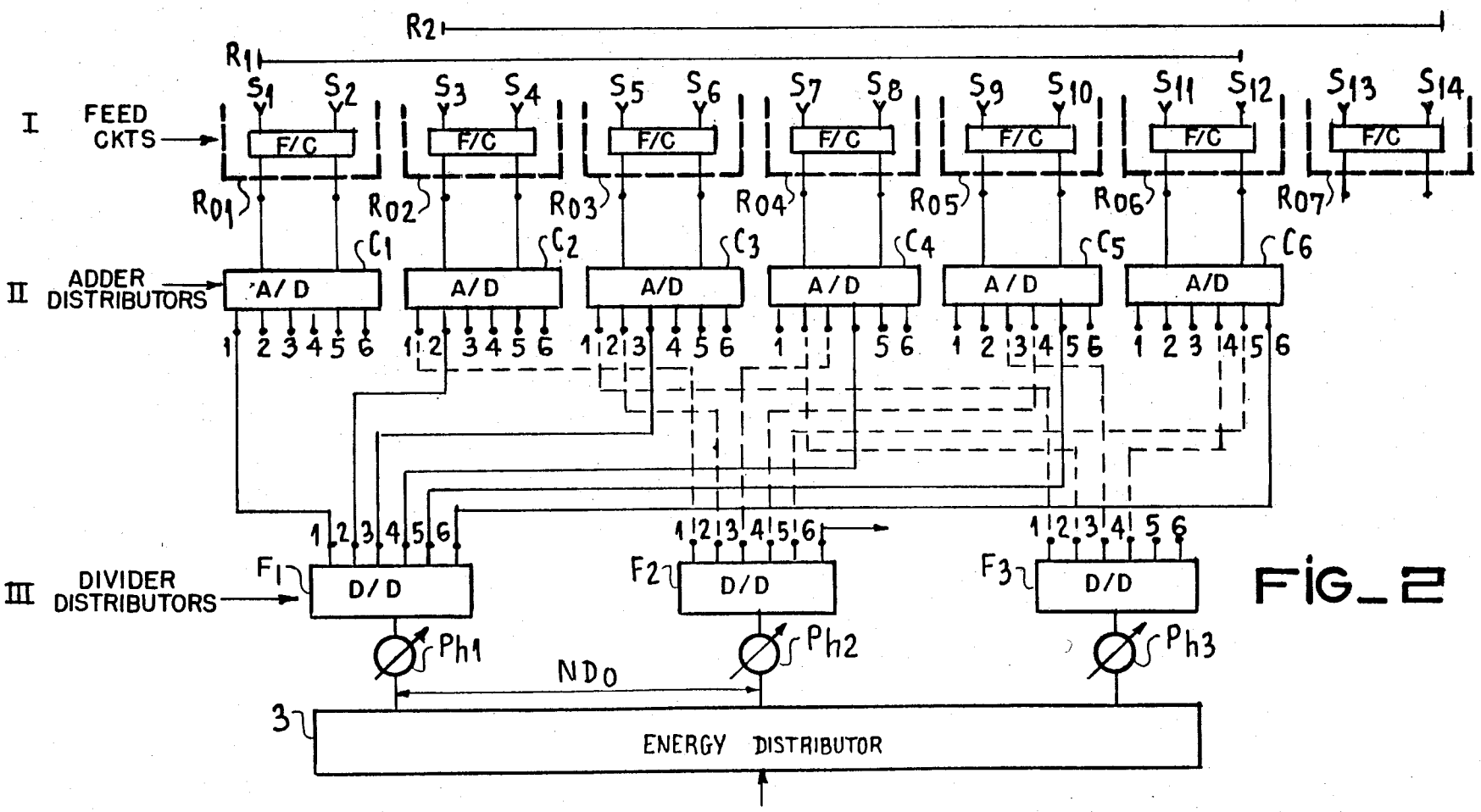
FIG. 2, a device for feeding elementary groups comprising two elementary antennae belonging to sub-arrays of twelve elementary antennae.

FIG. 2 shows a feed device in accordance with the invention feeding a number of elementary groups $Ro_1$ to $Ro_7$ with two antennae into which the sub-arrays are divided.

The sub-arrays considered here are shown by the references $R_1$ and $R_2$ and they are separated by N elementary intervals Do, here 2 Do. Each elementary group comprises an equal number of inputs and outputs. Here, this number N is equal to 2. Assembly II groups together the adder distributor circuits $C_1$ to $C_6$, combining together a certain number of elementary groups containing M.N elementary antennae, namely 12 antennae here, M being equal to 6. Assembly III groups together divider distributor circuits $F_1$ to $F_3$ each comprising an input connected to a phase-shifter Ph and M outputs. Phase-shifters Ph1 and Ph3 for example, already reduced in number, are connected to an energy distributor 3 whose corresponding outputs are spaced apart by N elementary spacings Do.

The feed of the antennae of the elementary groups from the energy distributor 3 takes place in the following way shown in FIG. 2. Each divider distributor circuit $F_1$ has a number of outputs equal to the number M of the inputs of the adder distributor circuits $C_i$ considered and each output is connected to an input of the same rank of the successive adder distributor circuits achieving a periodic connection law. Thus, output 1 of circuit 1 is connected to input 1 of circuit $C_1$, output 2 of circuit $F_1$ is connected to input 2 of circuit $C_2$, output 3 of circuit $F_1$ is connected to input 3 of circuit $C_3$ and so on up to the output 6 of circuit $F_1$ which is connected to the input 6 of circuit $C_5$. Similarly, the output of circuit $F_2$ is connected to the input 1 of circuit $C_2$, the output 2 of circuit $F_2$ is connected to the input 2 of circuit $C_3$, the output 3 of circuit $F_2$ is connected to the input 3 of circuit $C_4$ and so on. The output 1 of circuit $F_3$ is connected to the input 1 of circuit $C_4$, the output 2 of circuit $F_3$ is connected to the input 2 of circuit $C_4$ and so on.

Figure 3:
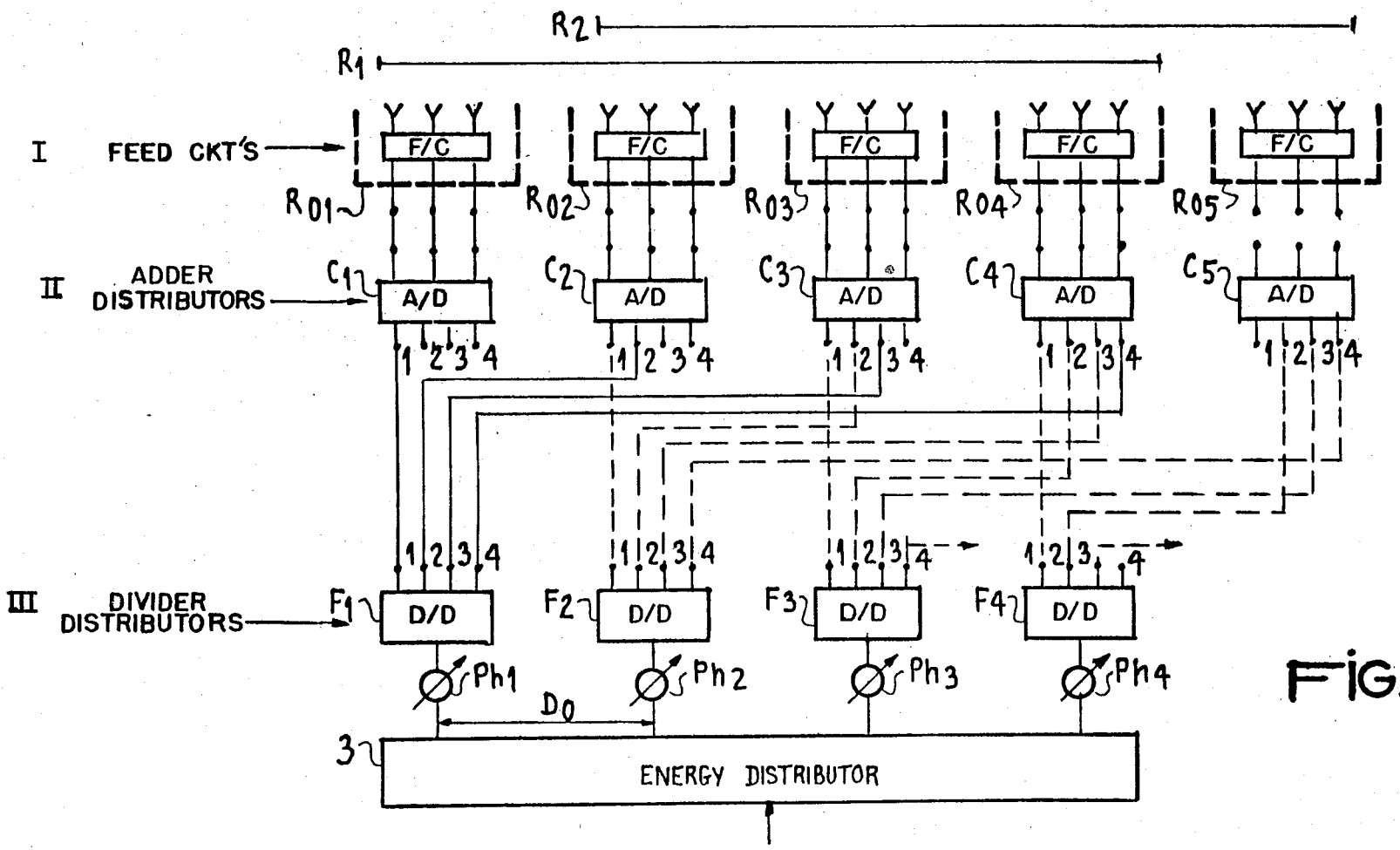
FIG. 3, a device for feeding elementary groups comprising three elementary antennae.

FIG. 3 shows a feed device in accordance with the invention, in which each elementary group $Ro_i$ comprises three elementary antennae. The sub-arrays $R_1$ and $R_2$ each comprise 12 antennae. These sub-arrays are spaced apart by NDo, i.e. three elementary intervals Do. Thus, the number of the adder distributor circuits of assembly H, i.e. M is equal to 4. Each of them comprises four inputs and three outputs, these latter being connected respectively to the three inputs of the elementary groups. The divider distributor circuits F, each of which is connected to the energy distributor 3 by a phase-shifter Phi, each comprise therefore one input and four outputs connected in the following way to the adder distributor circuits 11.

The output 1 of circuit $F_1$ is connected to the input 1 of circuit $C_1$, the output 2 of circuit $F_1$ is connected to the input 2 of circuit $C_2$, the output 3 of circuit $F_1$ is connected to the input 3 of circuit $C_3$ and its output 4 is connected to the input 4 of circuit $C_4$. For the circuit $F_2$, the connections are as follows: its output 1 is connected to the input 1 of circuit $C_2$, its output 2 is connected to the input 2 of circuit $C_3$, its output 3 to the input 3 of circuit $C_4$ and its output 4 to the input 4 of circuit $C_5$. The connections of the outputs of circuits $F_3$ and $F_4$ with the inputs of the circuits C is provided in the same way, the output 1 of circuit $F_3$ being connected to the N input 1 of circuit $C_3$ and the output 2 of circuit $F_4$ for example being connected to the input 2 of circuit $C_5$.

Figure 4:
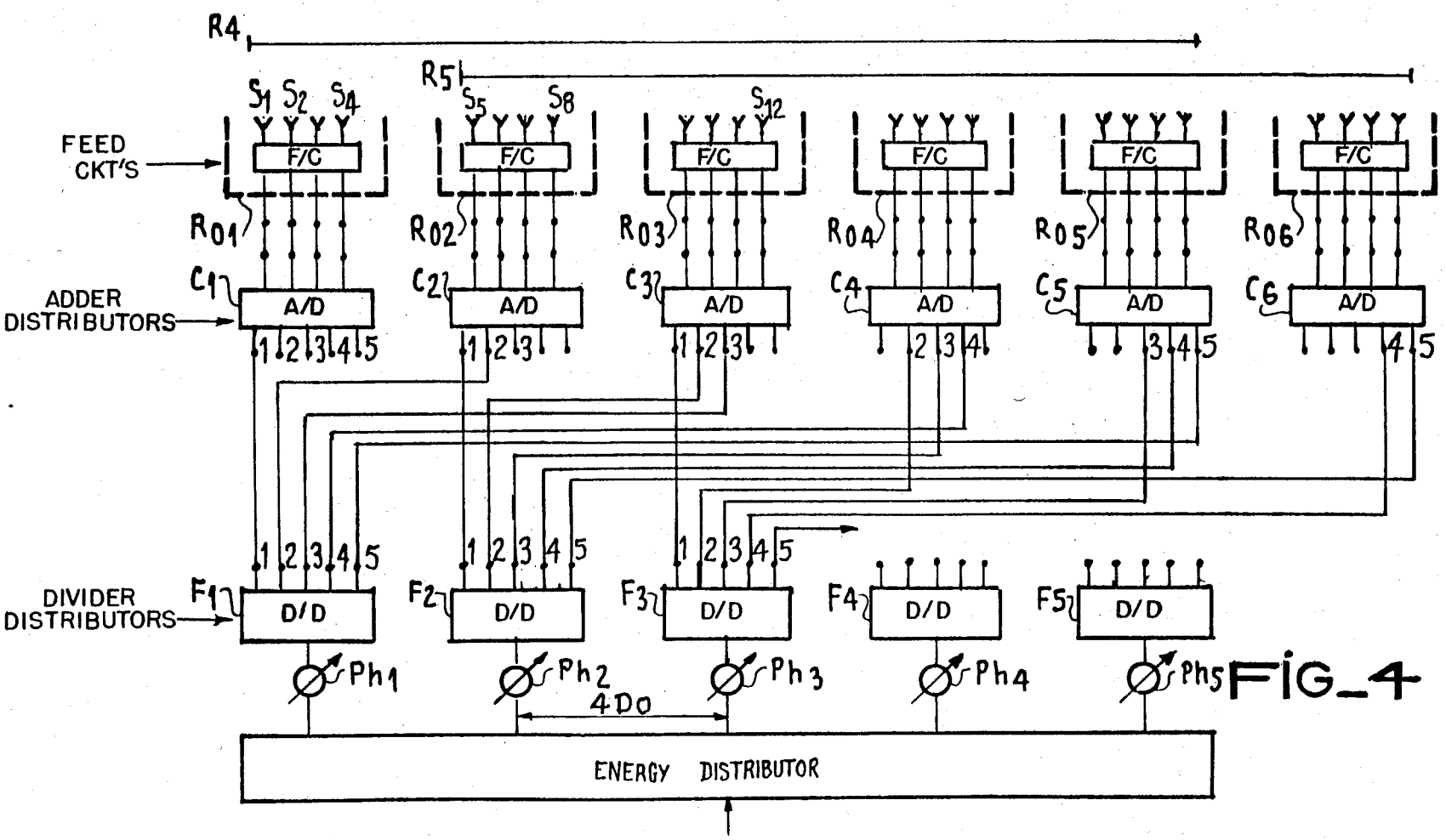
FIG. 4, a device for feeding elementary groups comprising four elementary antennae.

FIG. 4 shows a feed device in accordance with the invention, in which each elementary group $Ro_i$ comprises four elementary antennae. The sub-arrays $R_4$ and $R_5$ then each comprise 20 antennae. In fact, in accordance with the invention, the number M of interconnection circuits of the group must be greater than the number N of the elementary antennae of the elementary sub-arrays. Thus, with N being chosen equal to four, M must be equal to 5 at the minimum and the number of the antennae of a sub-array is equal to MN, i.e. 20. These sub-arrays are spaced apart by NDo, i.e. four elementary intervals Do. The number of the adder distributor circuits of N group 2 is equal to five and each comprises five inputs and four outputs, these latter being respectively connected to the four inputs of the elementary groups. The divider distributor circuits F, each of which is connected to the energy distributor 3 by a phase-shifter Ph, comprise therefore one input and five outputs connected in the following way to the adder distributor circuits 2.

Output 1 of circuit $F_1$ is connected to the input 1 of circuit $C_1$, output 2 of circuit $F_1$ is connected to the input 2 of circuit $C_2$, the output 3 of circuit $F_1$ to the input 3 of circuit $F_3$, the output 4 to the input 4 of circuit $C_4$, etc. Similarly, the output 1 of circuit $F_2$ is connected to the input 1 of circuit $C_2$, the output 2 to the input 2 of circuit $C_3$, etc. The connections of the outputs of circuits $F_3$,$F_4$, and $F_5$ are made in a similar way with the inputs of circuits $C_4$,$C_5$,$C_6$. It will also be noted that phase-shifters Phi are separated by four elementary intervals.

A number of experiments have been conducted with feed devices of the kind shown in FIGS. 1, 2, 3 and 4 comprising the combining means of the invention, i.e. for combining together an arbitrary number of elementary groups comprising N elementary antennae to form an assembly feeding MN elementary antennae forming a sub-array where M is greater than N with spacing between two sub-arrays equal to N elementary intervals.

In what follows, the limits of the sweep ranges obtained with a number of antennae varying from 8 to 44 are given for given elementary intervals increasing between two elementary antennae and a number varying from 2 to 4 for the elementary groups considered. The advantage will be seen in having as large an interval as possible between two elementary antennae which results in a lower density of elementary antennae or radiating sources.

The minimum number of antennae and phase-shifters depends on the interval between elementary antennae and on the number of antennae in the elementary group.

The optimum is then subject to the following restrictions:

1. maximum of Do
2. minimum of the number of antennae in the sub-array
3. maximum of the sweep range For example, for an elementary interval Do of 0.5λ and elementary groups with two antennae, we have

| number of antennae in a sub-array | sweep limit (in degrees) |
|---|---|
| 8 | 18.8 |
| 12 | 20.9 |
| 16 | 21.8 |
| 18 | 25 |
| 22 | 24.9 |

For an elementary interval of 0.7λ, still with elementary groups with two antennae, we have:

| number of antennae in a sub-array | sweep limit (in degrees) |
|---|---|
| 8 | 13.3 |
| 12 | 14.8 |
| 16 | 15.4 |
| 18 | 17.6 |
| 22 | 17.5 |

For an elementary interval of 0.5λ with elementary groups with three antennae, we have:

| number of antenna in a sub-array | sweep limit (in degrees) |
|---|---|
| 12 | 12.4 |
| 18 | 13.6 |
| 24 | 14.2 |
| 27 | 16.2 |
| 33 | 16.1 |

and for an elementary interval of 0.7λ with elementary groups having three antennae, we have:

| number of antennae in a sub-array | sweep limit (in degrees) |
|---|---|
| 12 | 8.8 |
| 18 | 9.7 |
| 24 | 10.1 |
| 27 | 11.5 |
| 33 | 11.4 |

For an elementary interval of 0.5λ with elementary sub-arrays having four antennae, we have:

| number of antennae in a sub-array | sweep limit (in degrees) |
|---|---|
| 16 | 9.2 |
| 24 | 10.1 |
| 32 | 10.5 |
| 35 | 12.0 |
| 44 | 11.9 |

and for an elementary interval of 0.7λ with elementary sub-arrays having four antennae, we have:

| number of antennae in a sub-array | sweep limit (in degrees) |
|---|---|
| 32 | 7.5 |
| 36 | 8.5 |
| 44 | 8.5 |

With the help of this table which may be easily completed, it can be seen that to obtain a sweep range of 12°, a sub-array is required having 36 antennae divided into nine elementary groups of four antennae each separated by 0.5λ. For a sweep range of 12.4°, a sub-array could be used having 12 antennae divided into four elementary groups of three antennae each separated also by 0.5λ.

In what follows, practical embodiments of circuits forming part of the invention will be described, providing several feeds for the elementary antennae and acting independently on the distribution of the amplitude and of the phase.

Figure 5:
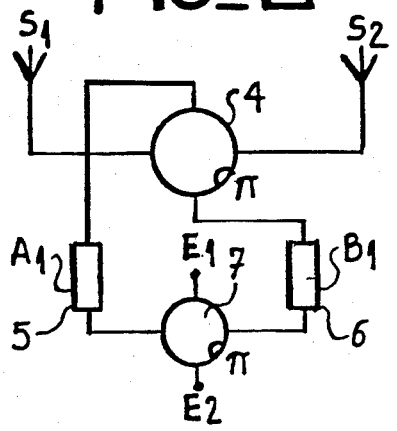
FIG. 5, a detailed device for feeding an elementary group with two elementary antennae.

FIG. 5 shows a circuit for feeding an elementary group comprising two antennae $S_1$ and $S_2$ connected by a hybrid circuit 4 to attenuator circuits 5 and 6 having respectively a certain weight $A_1.B_1$, themselves connected to the inputs $E_1$ and $E_2$ through a hybrid circuit 7. The separate feeds which are obtained for each of the two antennae $S_1$ and $S_2$ may be schematized in the following way:

$$I_1=(A_1+B_1)\cdot E_1+(A_1-B_1)E_2$$

$$I_2=(A_1-B_1)E_1+(A_1+B_1)E_2$$

$I_1$ and $I_2$ being the currents flowing respectively through the antennae $S_1$ and $S_2$.

Figure 6:
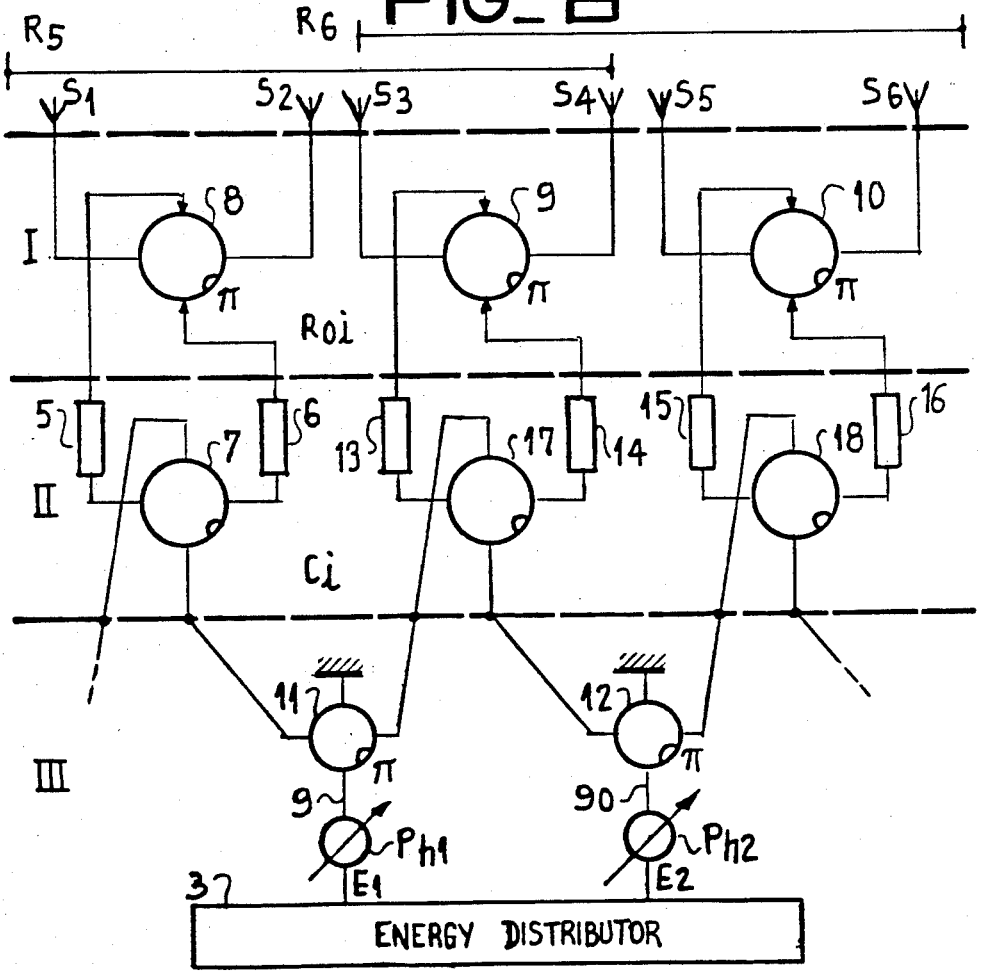
FIG. 6, a detailed feed device in accordance with the invention for three elementary groups having each two antennae.

FIG. 6 shows how to feed, under the optimum conditions of the invention, two sub-arrays $R_5$ and $R_6$ each comprising four antennae, namely $S_1$–$S_2$–$S_3$–$S_4$ and $S_3$–$S_4$–$S_5$–$S_6$ respectively, the two sub-arrays being spaced apart by two elementary intervals, i.e. the two antennae $S_3$ and $S_4$ are common to the two sub-arrays $R_5$ and $R_6$. The elementary groups into which the antennae of the sub-arrays are divided here comprise two antennae (N=2). The two antennae of each elementary group are fed through a hybrid divider 8,9,10 for obtaining, as was seen in connection with FIG. 5, two independent feeds for each of the antennae of an elementary group. In the case of FIG. 6, two elementary groups having two antennae each are combined by means of two divide-by-two circuits, namely 11 and 12. Each of these dividers is connected to an output $E_1$, respectively $E_2$, of an energy distributor 3, and of a phase-shifter $Ph_1$, respectively $Ph_2$, provided at the output of distributor 3. In this circuit, it can be seen that the signal applied to the input $E_1$ is divided, through divider 11, between the antennae $S_1$–$S_2$ on the one hand and $S_3$–$S_4$ on the other, and that the signal applied to $E_2$ is divided, through divider 12, between the antennae $S_3$–$S_4$ on the one hand and $S_5$–$S_6$ on the other. The antennae $S_3$ and $S_4$ therefore receive the sum of the signals of each of the inputs. Moreover, since coefficients $A_1$ and $B_1$ represent the weight of circuits 5,6,13,14,15 and 16, the desired distribution over the antennae may be obtained. The following table gives for each of the antennae $S_1$ to $S_6$ considered, the distribution of the amplitudes as a function of coefficients $A_1$ and $B_1$.

| | $S_1$ | $S_2$ | $S_3$ | $S_4$ | $S_5$ | $S_6$ |
|---|---|---|---|---|---|---|
| $E_1$ | $A_1-B_1$ | $A_1+B_1$ | $A_1+B_1$ | $A_1-B_1$ | 0 | 0 |
| $E_2$ | 0 | 0 | $A_1-B_1$ | $A_1+B_1$ | $A_1+B_1$ | $A_1-B_1$ |

From this table, the currents $I_1$ and $I_6$ which flow through the different antennae may be deduced.

In accordance with the invention, this feed device providing several separate feeds for each antenna, apart from the antennae situated at the ends of the endmost sub-arrays, may be extended to any arbitrary number of antennae divided into sub-groups and elementary groups. For this, the number of circuits of the kind 5,6, for example attneuators, is increased that is to say that the number of coefficients A and B is increased. Also in accordance with the invention, the coefficients are grouped together in a hybrid bridge thus providing two symmetrical excitations for each antenna. This way of operating presents a certain advantageous simplification. Thus, with three sets of coefficients, namely $A_1,B_1$; $A_2,B_2$ and $A_3,B_3$, a symmetrical excitation is obtained over six groups of two antennae, i.e. for a sub-array comprising 12 antennae with optimum distribution of the currents over the 12 antennae.

Figure 7:
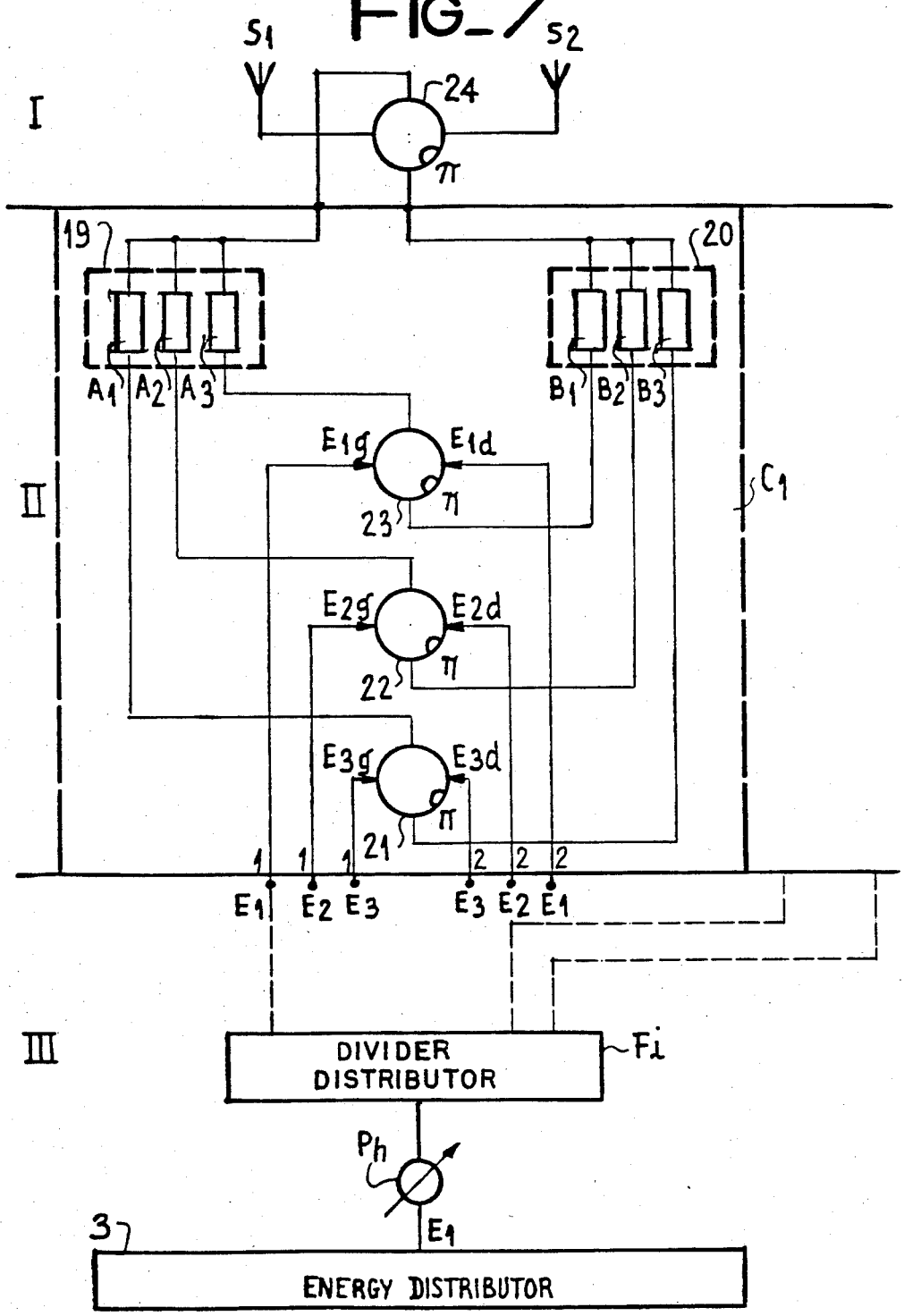
FIG. 7, a symmetrical feed device for an elementary group of two antennae, belonging to a sub-array of twelve antennae.

FIG. 7 shows such a feed device designed for an elementary group comprising two antennae. This feed device comprises six separate inputs $E_{3g},E_{2g},E_{1g}$ and $E_1d,E_2d$, and $E_{3d}$ and supplies 12 separate excitation currents.

It will be noted that the feed device of FIG. 7 is formed from hydrid dividers. The energy inputs $E_1^1$-,$E_2^1$,$E_3^1$ and $E_1^2$,$E_2^2$,$E_3^2$ are connected symmetrically on the left and the right to circuits 19 and 20, defining coefficients A and B for example, in the case represented $A_1,A_2,A_3,B_1,B_2,B_3$ and are applied to three divide-by-two circuits, namely 21, 22 and 23. There can also be seen in this figure the division of the circuits into group 1, elementary groups Roi, group II, adder distributor circuits Ci and group III divider distributor circuits Fi.

The twelve separate currents for exciting the left-hand and right-hand antennae of the elementary groups may then be defined:

| | $E_{3g}$ | $E_{2g}$ | $E_{1g}$ | $E_{1d}$ | $E_{2d}$ | $E_{3d}$ |
|---|---|---|---|---|---|---|
| L/H antenna ($S_1$) | $A_3-B_3$ | $A_2-B_2$ | $A_1-B_1$ | $A_1+B_1$ | $A_2+B_2$ | $A_3+B_3$ |
| R/H antenna ($S_2$) | $A_3+B_3$ | $A_2+B_2$ | $A_1+B_1$ | $A_1-B_1$ | $A_2-B_2$ | $A_3-B_3$ |

If $I_1,I_2,I_3,I_4,I_5$ and $I_6$ are the desired current amplitudes, the values of coefficients $A_1.B_1,A_2.B_2,A_3.B_3$ may be easily determined, namely:

$$A_1=\tfrac{1}{2}(I_1+I_2)\quad A_2=\tfrac{1}{2}(I_3+I_4)\quad A_3=\tfrac{1}{2}(I_5+I_6)$$

$$B_1=\tfrac{1}{2}(I_1-I_2)\quad B_2=\tfrac{1}{2}(I_3-I_4)\quad B_3=\tfrac{1}{2}(I_5-I_6)$$

There may also be determined without ambiguity, by means of a system of six non linear equations with six unknowns, the different parameters of the distribution, including the values of the couplings for obtaining an optimum distribution of the currents over the twelve antennae considered.

By way of non limiting example, the coupling values between the twelve antennae, starting from the left, are given below:

0.071; −0.039; −0.178; −0.45; 0.478; 1; 1; 0.478; −0.45; −0.0178; −0.039; 0.071.

In the preceding description, elementary groups were considered comprising two antennae and sub-arrays spaced apart by two intervals, covering two antennae. It is obvious that the invention is not limited to these data.

The elementary groups may very well comprise three or four antennae or more, with sub-arrays spaced apart by a corresponding interval, as shown in FIGS. 3 and 4 for example. However, a feed similar to that of FIG. 7 for an elementary group comprising three elementary antennae becomes relatively complicated in practice.

Figure 8:
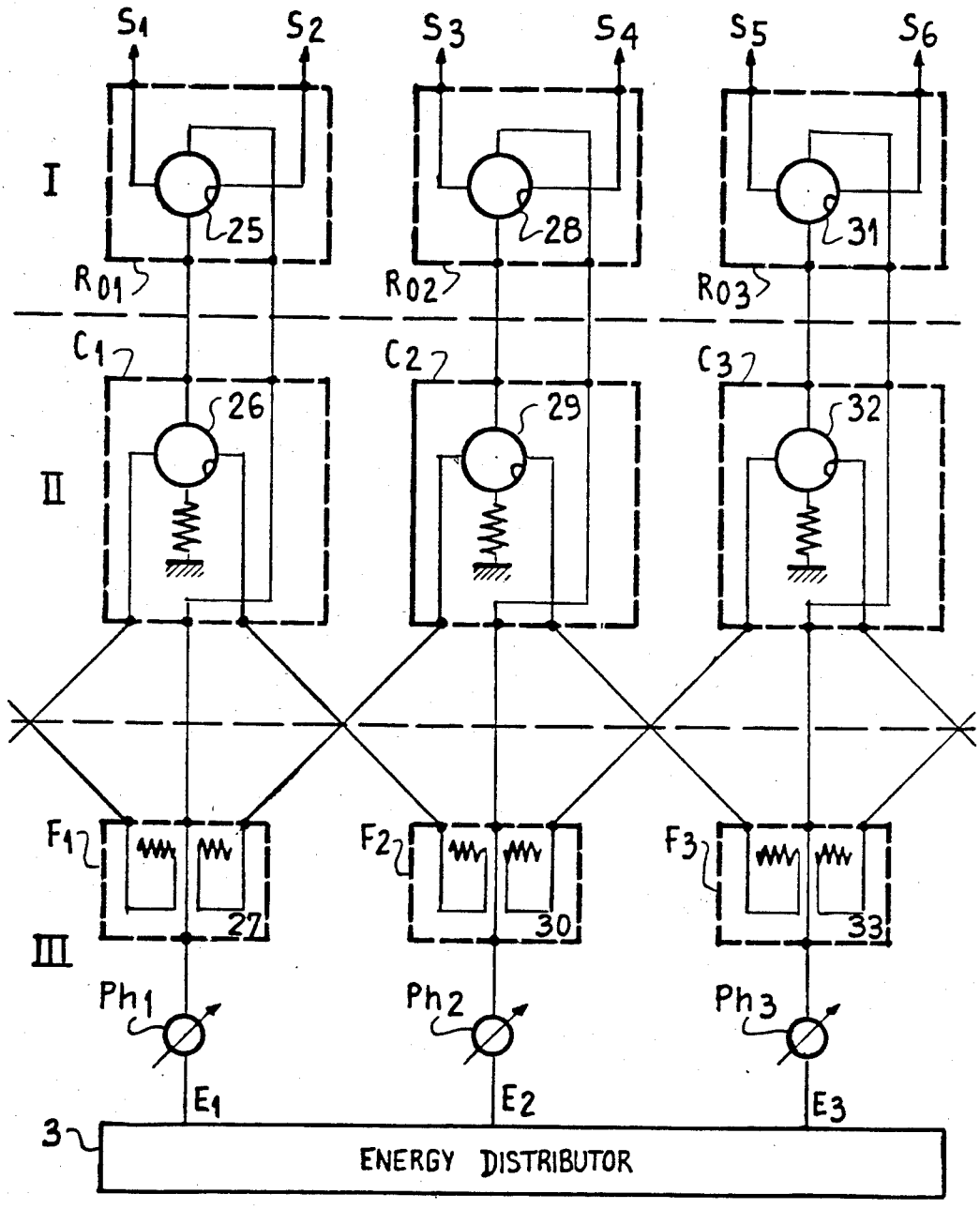
FIG. 8, a simplified feed device for a sub-array formed by three elementary groups each of two antennae.

FIG. 8 shows a simplified embodiment of a feed, in accordance with the invention, for six elementary antennae divided into three elementary groups of two antennae each. The optimum theoretically obtainable distribution of the coupling values between two antennae would be:

−0.157; 0.238; 1; 1; 0.238; −0.157. In the practical example of FIG. 8, this distribution is: −0.17; 0.17; 1; 1; 0.17; −0.17 for obtaining a sweep range of ±8° with a maximum level of the array lobes equal to about −26 dB.

The elementary sub-arrays Ro1, Ro2,Ro3 belonging to group I of circuits, each comprise two elementary antennae $S_1$–$S_2$; $S_3$–$S_4$; $S_5$–$S_6$, which are connected respectively through hybrid couplers 25,28 and 31 to the group II adder distributer circuits. These latter are hybrid couplers 26,29, 32 having one output connected respectively to the corresponding elementary group with two inputs, connected respectively to triple couplers 27,30,33. The triple couplers are connected respectively to an energy distributor 3 by phase-shifters Ph1, Ph2, Ph3, separated by two elementary intervals.

On the basis of the result obtained, a sweep range of ±8° with a maximum level of the array lobes equal to about −26 dB, the circuits provided in accordance with the invention may be compared with those which U.S. Pat. No. 4,228,436 cited as representative of the prior art would have required. With the teaching of this patent, it would have been necessary to use a spacing between sub-arrays of 1.25λ i.e. an elementary spacing of 0.4λ instead of 0.8λ in the embodiment of the present invention. The number of sources is thus divided by more than two. The number of phase-shifters which may be expressed by the ratio between the distances between sub-arrays is reduced in a proportion of 40%.

Figure 9:
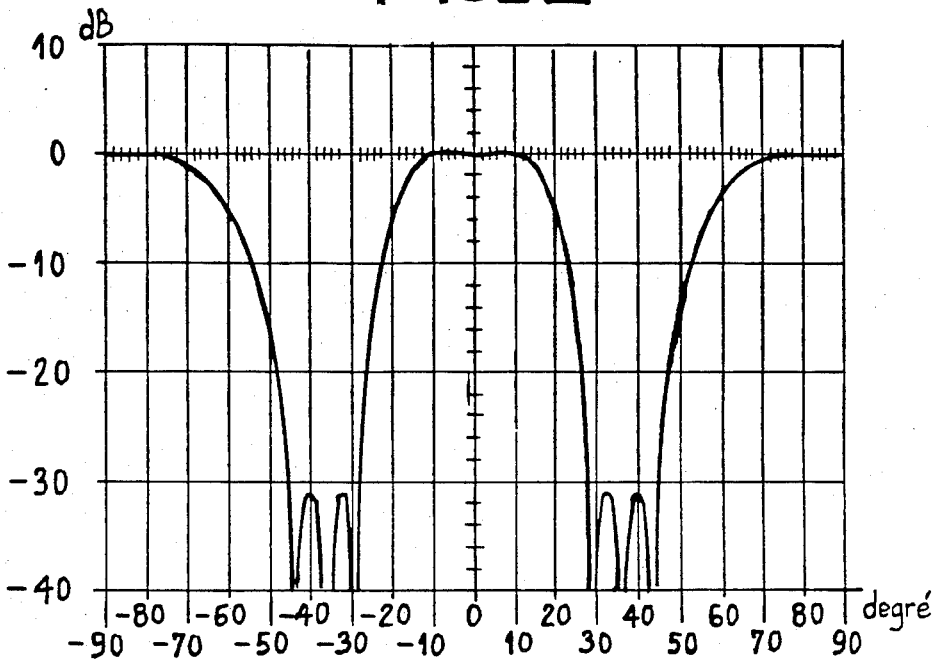
FIG. 9, the radiation diagram obtained with the symmetrical feed of FIG. 8.

FIG. 9 shows the radiation diagram obtained with the feed of FIG. 7. It can be seen that the sweep range extends between ±8°.

Figure 10:
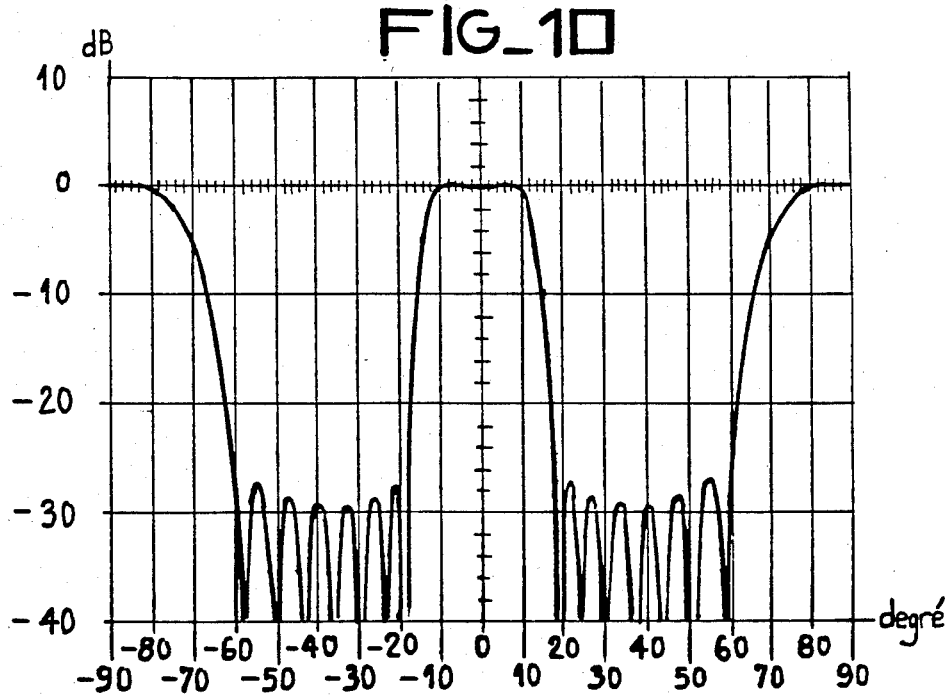
FIG. 10, the radiation diagram obtained with the symmetrical feed of FIG. 7.

FIG. 10 shows the radiation diagram obtained with the symmetrical feed of FIG. 8. The sweep range is extended between ±12° and the maximum of the array lobes is of the order of −26 dB.

Figure 11:
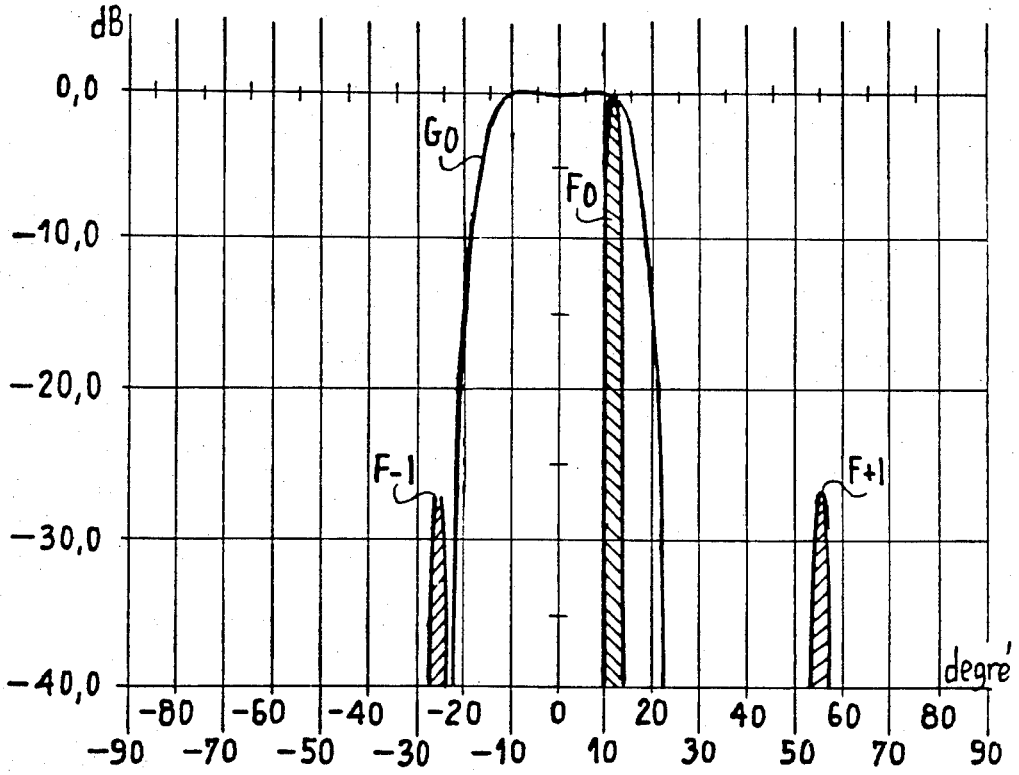
FIG. 11, the radiation diagram obtained for an antenna formed by 28 sub-arrays, each of 12 antennae with a spacing of two elementary intervals between sub-arrays.

FIG. 11 shows the radiation diagram obtained with a feed in accordance with the invention for 28 sub-arrays of 12 antennae each with elementary groups of 2 antennae and an interval Do of 0.8λ.

Fo represents the resulting lobe from 28 sub-arrays of 12 antennae each separated by 0.8λ with spacing between sub-arrays of 2 Do, i.e. 1.6λ. Lobe Fo is shown for 12° off-aiming with an array lobe F−1 and F+1 less than 26 dB. The admissible sweep range with a loss of 3 dB on the principal lobe Fo is of the order of ±15°.

Diagram Go shows the diagram of each sub-array of 12 elementary antennae.

Thus, a device has been described for feeding a sweep beam array antennae.

What is claimed is:

1. A feed device for a sweep beam array antennae, the elementary antennae of said array being spaced apart by an elementary interval and divided into several sub-arrays overlapping at their ends, comprising:

means for forming a plurality of elementary groups, each comprising N antennae of said sub-arrays and having N inputs and N outputs, and means for combining together an arbitrary number of said elementary groups comprising MN antennae, where M is a whole number greater than N, these means including a number of outputs N equal to the number of inputs of said forming means to which they are connected, and M inputs connected to an energy distributor, spacing between two said sub-arrays being equal to N elementary intervals, said means for combining including a plurality of adder distributor means, each having N outputs coupled to said N inputs of a respective one of said elementary groups, and each having M inputs, each one of said plurality of adder distributor means including weighting means for delivering on said adder distributor means N outputs weighted sums of energies received on said adder distributor means M inputs.

2. The feed device as in claim 1, wherein said means for combining together an arbitrary number of said elementary groups further includes a plurality of divider distributor circuits, each having M outputs connected to the M inputs of selected one of said adder distributor circuits according to a periodic law.

3. The feed device as in claim 2, wherein each divider distributor circuit has one input connected to said energy distributor by a phaseshifter, and a number of outputs equal to M, each of these M outputs being connected to an input of the same rank of successive adder distributors, achieving a periodic law of connection between said divider distributors and said adder distributors.

4. The feed device as in claim 3, wherein the phase-shifters through which said divider distributors are connected to said energy distributor are separated by N elementary intervals.

5. The feed device as in claim 1, wherein said elementary groups comprise two to five elementary antennae.

6. The feed device as in claim 1, wherein each of said elementary groups includes two elementary antennae fed through a first hybrid circuit by two circuits of predetermined weight, said two circuits connected to said N inputs through a second hybrid circuit.

7. The feed device as in claim 2, wherein each of said elementary groups, said adder distributor circuits and said divider distributor circuits include hybrid circuits.

8. The feed device as in claim 2, further including a plurality of feed circuits each feed circuit delivering, to an elementary group comprising two said elementary antennae connected to a respective adder distributor through a hybrid divider having two inputs, twelve separate excitation currents, wherein each of said adder distributor circuits comprises six separate inputs disposed symmetrically, and three hybrid dividers having symmetrical inputs connected respectively to said six inputs, outputs from said three hybrid dividers being combined in output pairs which are connected respectively to the two inputs of the hybrid divider feeding said elementary antennae through circuits of predetermined weight.

9. The feed device as in claim 2 further including a plurality of feed circuits for feeding the sub-arrays from said adder distributor circuits, each said feed circuit including a hybrid divider, and wherein said adder distributor circuits include hybrid dividers, and wherein said divider distributor circuits include triple couplers, each of said couplers being connected to said energy distributor through a phase-shifter.

10. A feed device for a sweep beam array antennae which has a plurality of elementary antennae combined into a plurality of elementary groups, each elementary group having N elementary antennae and N inputs, comprising:

energy distributor means adapted to receive input energy and having a plurality of outputs;

a plurality of divider distributor circuits, each one coupled to a respective one of said energy distributor means outputs and having M outputs, M being greater than N; and a plurality of adder distributor circuits, each one having N outputs coupled to the N inputs of a respective one of said elementary groups, and M inputs coupled to the M outputs of predetermined ones of said divider distributor circuits according to a periodic law, each one of said plurality of adder distributor circuits including weighting means for delivering on said N outputs weighted sums of energies received on said M inputs.

11. A device according to claim 10 further including a plurality of phase shifters, each one coupled between a respective one of said divider distributor circuits and a respective one of said energy distributor means outputs.

12. A device according to claim 10 further including a plurality of feed circuits, each one having N inputs coupled to the N outputs of a respective one of said adder distributor circuits, and N outputs coupled to the N inputs of a respective one of said elementary groups.

13. A device according to claim 12 wherein each of said feed circuits, each of said divider distributor circuits, and each of said adder distributor circuits includes a hybrid circuit.

14. A device according to claim 12 wherein each adder distributor circuit includes:

a hybrid divider coupled to one of said divider distributor circuits; and a plurality of circuits having a predetermined weight, each one coupled between said hybrid dividers and one of said feed circuits.

* * * * *